United States Patent [19]

Sargent

[11] Patent Number: 4,727,699

[45] Date of Patent: Mar. 1, 1988

[54] ROOFING MEMBRANE SECUREMENT SYSTEM

[76] Inventor: Richard G. Sargent, 70G West Briar, Stafford, Va. 22554

[21] Appl. No.: 35,422

[22] Filed: Apr. 7, 1987

[51] Int. Cl.[4] ..... E04B 2/08; E04D 3/36; A44B 21/00

[52] U.S. Cl. ..... 52/410; 24/459; 52/222; 52/512; 52/713

[58] Field of Search ..... 52/410, 512, 222, 713; 24/459–462, 90 C, 90 E, 92, 113 R

[56] References Cited

U.S. PATENT DOCUMENTS

| | | | |
|---|---|---|---|
| 1,452,052 | 4/1923 | Nalle | 24/90 C |
| 3,426,412 | 2/1969 | Streng et al. . | |
| 4,233,790 | 11/1980 | Meadows | 52/222 |
| 4,502,256 | 3/1985 | Hahn . | |
| 4,520,606 | 6/1985 | Francovitch . | |
| 4,617,771 | 10/1986 | Tomaszewski . | |
| 4,624,092 | 11/1986 | Baginski . | |
| 4,631,887 | 12/1986 | Francovitch . | |
| 4,638,532 | 1/1987 | Yang et al. . | |
| 4,658,558 | 4/1987 | Verble | 52/410 |

FOREIGN PATENT DOCUMENTS 1609328 4/1970 Fed. Rep. of Germany .

*Primary Examiner*—Alfred C. Perham
*Attorney, Agent, or Firm*—Beveridge, DeGrandi & Weilacher

[57] ABSTRACT

A roofing membrane securement system having an upper member and a lower member each of which is formed of a relatively hard, unyielding material. The lower member includes a bottom surface from which extends a preferably cylindrical wall. In one embodiment a plurality of ledges extend downwardly and inwardly from the upper edge of the inner surface of the circumferential wall. The upper member is preferably of circular shape, having a diameter less than that of the interior cross-sectional dimension of the cylindrical wall but greater than the distance between the innermost edges of circumferentially opposed ledges. In a second embodiment, ledges extend downwardly from the upper edge of the outer surface of the lower member circumferential wall, and the upper member has a downwardly extending wall adjacent the circumferential wall outer surface with ledges extending radially inwardly therefrom to engage beneath the lower member ledges. To secure a roofing membrane to a roof substrate, a plurality of lower members are fastened to the roof substrate at desired locations, and the roofing membrane is laid over the substrate and the lower members. Upper members are placed on the roofing substrate, over each lower member. Downward pressure is applied to each lower member, causing the lower member to snap into place so as to position both the roofing membrane and the upper member beneath the ledges. The necessary flexibility of the unyielding material is achieved by providing slots through the cylindrical wall or by arcuate slots in an area of the bottom surface directly below the ledges.

13 Claims, 8 Drawing Figures

ROOFING MEMBRANE SECUREMENT SYSTEM

TECHNICAL FIELD

The present invention relates to a securement system for securing a roofing material such as a roofing membrane to a structure such as the roof of a building.

BACKGROUND OF THE ART

For a long period of years roofs were covered by applying multiple layers of material with at least one of those layers usually being a moisture resistant material such as a felt material soaked in bitumin. To prevent the wind from tearing away the layers of the roofing material, gravel was often used to hold down the multiple layers.

Recent advances, especially in the material manufacturing area, have led to the development of a number of new approaches to applying roofing material. One which has gained considerable acceptance, due mostly to its ease of application, is the single ply roofing system. The single ply roofing system involves the covering of a roof substrate with one or more layers of a membrane of a suitable elastomeric material such as neoprene, polyvinyl chloride, ethylene propylene diene monomer or the like. Multiple ply membranes of different materials or of a single material may also be used. Roofing membranes of this type are generally manufactured in large sheets ranging from 3 to 40 feet in width and in lengths of up to 125 feet or more. For ease in shipping and subsequent application the sheets are generally sold in rolls.

In applying a roofing membrane to a roof substrate, two areas are of great concern, namely preventing water leakage through the membrane to the substrate below and preventing wind forces from tearing the membrane off the underlying substrate.

Securement of the roofing membrane to an underlying substrate, which can be any type of material such as sheet metal, cork board, insulation board, concrete or the like, can be accomplished in several different ways, for instance, the ballast method involving utilizing stones to weight the membrane down or an adherence method which involves applying an adhesive to the substrate and rolling out sheets of the roofing membrane over the adhering substrate. The ballast method and the adherence method, however, present difficulties when it is desired to replace a worn roofing membrane with a new one. Both the adherence system and ballast system involve substantial labor and material costs each time an old membrane is to be replaced with a new membrane.

Alternatively, a partially attached system may be utilized whereby a number of anchoring or securement devices secure the membrane to the substrate at a number of different points. If the securement devices are made so as to be easily detachable and reusable, extensive labor and material cost savings can be achieved. However, the use of a partially attached or point attachment system presents a number of problems itself. For example, the point attachment system, unlike the ballast or adhesive system, secures the roofing membrane to the roof substrate at a number of isolated points rather than over the entire surface area of the membrane and/or substrate. In high wind areas this can present a problem, since prevention of wind damage requires that the points of attachment be concentrated to such an extent as to make the use of such a system impractical.

Another problem associated with a point attachment system arises when the particular system involves a fastener which penetrates the membrane. Penetration of the membrane creates a location where leakage can occur, and, to compensate, additional labor and materials are required for sealing off the area of leakage, thus making the use of such a system economically impractical.

To achieve the possible advantages the point attachment system has over other systems in ease of roof membrane application and removal and reusable securement means, it is necessary that the foregoing problems be dealt with. The labor costs can be reduced by utilization of a securement means which can be easily inserted or assembled and withdrawn or disassembled and by avoiding penetration of the roofing membrane. Material costs can be greatly reduced if the securement means can be used over and over again without loss of its securement power. To achieve both a labor cost reduction and a material cost reduction has proven to be difficult in that generally the reduction of labor costs is brought about by factors resulting in a corresponding rise in material cost, or vice versa. To develop a securement means which can be repeatedly reused requires that the material of which it is made be capable of withstanding extreme weather and temperature variations while at the same time retaining its fastening strength even after repeated insertions or withdrawals.

Francovitch U.S. Pat. No. 4,520,606 illustrates various embodiments of roofing membrane anchors. FIGS. 1–4 of the Francovitch patent depict anchoring systems each having a linear fastener extending through the membrane. As previously discussed, such systems result in undesirable labor costs, as the point of penetration must be sealed to prevent leakage.

FIGS. 5–9 of the Francovitch patent show a solution to the problem of increased labor cost due to sealing requirement. In these figures various embodiments of head and socket arrangements are illustrated which do not require roofing membrane penetration. However, the locking components are formed of either a resilient plastic or a rubber material, each of which is susceptible to deterioration over extended periods of time in extreme weather conditions, such as extreme heat and extreme cold, as experienced over a number of years. This deterioration results in the locking members losing their fastening powers or in cracks developing, especially after repeated bendings due to assembly and disassembly. Also, during assembly and disassembly the type of material used is readily susceptible to damages caused by a workman's tool or the like.

Francovitch's FIG. 10 reveal yet another roofing membrane anchoring system which utilizes an upper plate element, including a key portion, and a lower plate having a notch in it. Securement of the two plates with the roofing membrane therebetween is achieved by placing the key portion in the notch and rotating the upper plate until the key lies beneath a shoulder of the lower plate. This system requires the use of a tool to rotate the upper plate and thus requires increased capital expenditure and labor to insert the tool and rotate the upper plate. Moreover, the system fails to provide a sufficiently secure locking system, as vibrations or other naturally occurring events may cause the upper plate to rotate to the unlocked position.

SUMMARY OF THE INVENTION

The present invention is a roofing membrane securement system free of the above problems. In accordance with the invention, a roofing membrane securement system includes an upper member and a lower member, both formed of a relatively hard and unyielding material such as hard plastic and thus are capable of withstanding extreme weather and temperature variations over extended periods of time. To secure a roofing membrane to a roof substrate in accordance with the invention, a plurality of the lower members are dispersed over and fastened to the roof substrate. Each lower member has a bottom surface in the form of a plate or disc which is in contact with the substrate. The plate can be fastened to the substrate by one or more fasteners such as screws or bolts and nuts. A circumferential wall extends up from the bottom surface, and near the upper edge of the wall ledges extend downwardly from one surface of the circumferential wall. In one embodiment, the ledges extend from the inner surface of the circumferential wall, and directly below the ledges arcuate slots are formed in the bottom surface, with the outermost edges of the slots substantially corresponding with the inner surface of the circumferential wall. In another embodiment the ledges again extend from the inner surface of the wall, and vertical slots extend through the wall from the wall upper edge to a point at or near the lower member bottom surface. In a third embodiment, the ledges extend from the outer surface of the wall, and again vertical slots extend through the wall from the upper edge to a point at or near the bottom surface, although arcuate slots in the bottom surface could be provided instead.

Securement of the roofing membrane is accomplished by laying the roofing membrane over the substrate and the plurality of lower members and then "snapping" beneath the ledges a corresponding plurality of upper members, each having a cross sectional dimension selected to permit the upper member to engage the lower member ledges to retain the securement system in place with the roofing membrane therebetween. Thus, in the first and second embodiments, the upper members have a cross-sectional dimension less than that of the interior of the circumferential wall but greater than the distance between the innermost edges of circumferentially opposed ledges. In the third embodiment, the upper member has a cross-sectional dimension greater than that of the lower member, and a downwardly extending side surface extends adjacent the lower member circumferential wall. A radially inwardly extending ledge on the upper member snaps beneath and engages the lower member ledge.

Such a fastening system requires no penetration through the roof membrane and hence no sealing. Additionally, with respect to much of the prior art the upper member has a relatively large cross sectional dimension and thus acts to hold down a relatively large area of the roofing membrane. Such a feature allows for less of a concentration of securement systems, even in high wind areas, and therefore a saving in labor costs. Labor costs are further reduced by the fact that tools are not required to apply the upper members but rather the upper members can be snapped into place by hand or by stepping down on the upper members.

As mentioned previously, both the upper and lower members are made of a relatively hard and unyielding material such as a hard plastic. As the material is virtually unyielding, the necessary flexibility for placement of the upper member below the ledges is achieved by structural modification rather than use of a resilient material. By placing slots in the bottom surface of the lower member directly below the ledges or in the wall of the lower member, the necessary flexibility is achieved without using a resilient material. This is important, as an unyielding material such as a hard plastic is inherently better suited to withstand the extreme weather and temperature variations. Moreover, the slots relieve the stress on the circumferential wall during assembly and disassembly and therefore, unlike the prior art, repeated assembly and disassembly does not weaken the securement power of the system to any significant extent.

BRIEF DESCRIPTION OF THE DRAWINGS

These and other aspects and many of the attendant advantages of the present invention will be readily understood from the following detailed description, claims and drawings. In the drawings:

DESCRIPTION OF A PREFERRED EMBODIMENT

Figure 1:
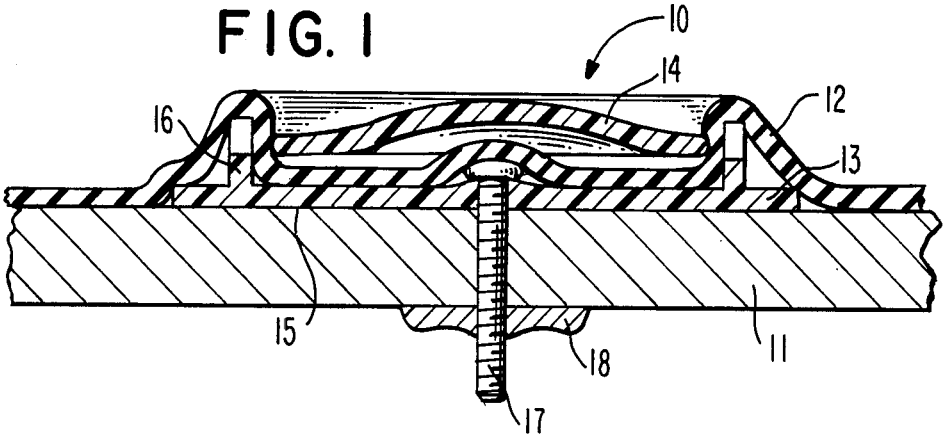
FIG. 1 is a vertical cross-sectional view of a preferred embodiment of a roofing membrane securement system in accordance with the present invention.

FIG. 1 is a cross-sectional view of a roofing membrane securement system 10 shown in place upon a roof substrate 11. The roof substrate can be of any roof material, including, but not limited to, steel, gypsum, wood, concrete, roof insulation, or an existing built up roof. FIG. 1 shows the securement system 10 in its secured position with the roofing membrane 12 secured between a lower member 13 and an upper member 14. Both lower member 13 and upper member 14 are formed of a relatively hard and unyielding material. A hard plastic material has proven to be adequate for the purposes of the present invention but the invention is not limited to such a material. While nylon is presently preferred, suitable materials may also include polystyrene, polyethylene, polypropylene, various polyesters, and other resinous materials. Both the upper and lower members can be formed of the same material or they can be formed of different materials.

The bottom surface 15 of lower member 13 can be of any desired shape and preferably is a regular shape such as a circular shape or a polygonal shape. Extending upwardly from the bottom surface 15 and forming a part of lower member 13 is a circumferential wall 16 shown to be cylindrical in shape but not limited to that specific shape. A fastening means 17 such as a bolt or the like, in combination with a nut or other locking member 18, acts to secure the lower member 14 to the roof substrate 11. Of course, in some situations a locking member would not be necessary such as in the situation where the roof substrate 11 has a threaded bore therein.

Figure 2:
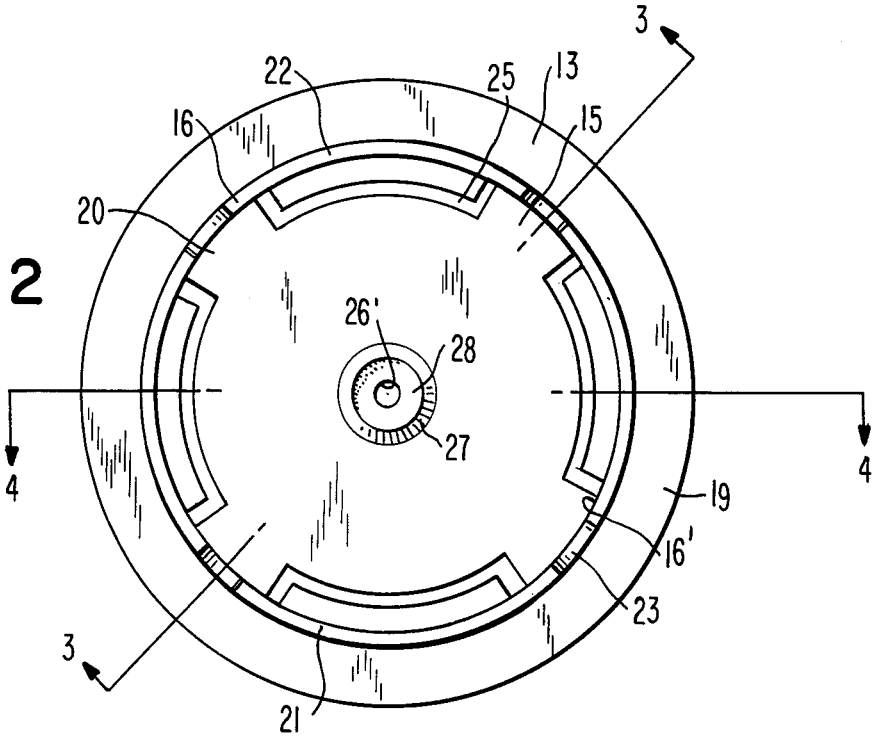
FIG. 2 is a plan view of the lower member of the system of FIG. 1.

FIG. 2 depicts a plan view of the lower member 13 in the disassembled state. Bottom surface 15 includes an outer flange portion 19 and an interior portion 20. Circumferential wall 16 extends upwardly from bottom surface 15 between outer portion 19 and interior portion 20. Ledges 21 extend inwardly from the interior surface 16' of circumferential wall 16.

Figure 3:
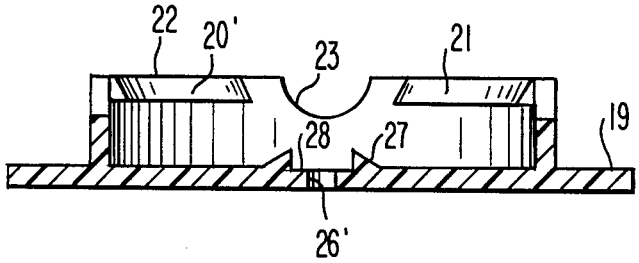
FIG. 3 is a cross-sectional view taken on line 3—3 of FIG. 2.
Figure 4:
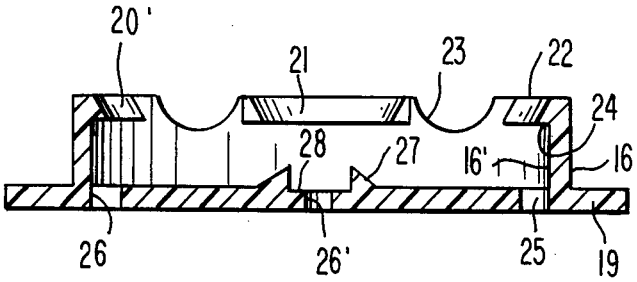
FIG. 4 is a cross-sectional view taken on line 4—4 of FIG. 2.

With reference to FIGS. 3 and 4, each ledge 21 has an upper edge 22 which substantially coincides with the upper edge of circumferential wall 16. The ledges 21 slope downwardly and inwardly at about a 45° angle to a substantially horizontal bottom edge 24 located about a third of the way down wall 16 from upper edge 22. It should be understood, however, that the angle of the slope and location of the horizontal bottom edge can be varied as circumstances warrant. Further, the sloped surface 20' need not be flat or planar but may have a slight concave curvature, if desired.

Below each of the ledges 21 is an arcuate slot 25 having a length which is preferably equal to or just slightly greater than the length of the corresponding ledge 21 above. Additionally, as depicted in FIG. 4, the outermost edge 26 of each slot 25 substantially coincides with the inner surface 16' of wall 16. The slots 25 allow the substantially unyielding material forming lower member 13 to flex the necessary amount to permit upper member 14 to snap to its assembled position beneath ledges 21.

FIGS. 3 and 4 also depict recesses 23 formed in upper edge 22 of wall 16 between each adjacent pair of ledges 21. The recesses 23 are semi-circular in shape and have a radius which is preferably slightly shorter than the distance between the bottom edge 24 of each ledge and the upper edge 22 of wall 16. Recesses 23, like slots 25, also help to relieve any stresses which develop when upper member 14 is snapped into position below the ledges 21.

In the interior portion 20 of bottom surface 15 a through hole 26' is formed to allow the fastening member 17 to pass through. A collar 27 is formed about the throughhole 26'. Collar 27 has gradually raised outer edges to provide a smooth surface upon which the roofing membrane 12 can rest. The diameter of collar 27 is somewhat larger than the throughhole area 26. The housing area 28 within collar 27 provides an area in which the head of fastening member 17 can rest and thereby protects membrane 12 from any sharp surfaces on the head of the fastening member.

Figure 5:
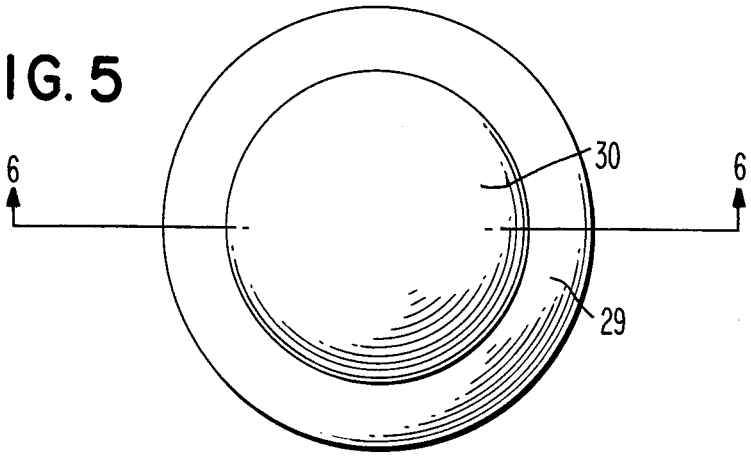
FIG. 5 is a plan view of the upper member of the system of FIG. 2.
Figure 6:
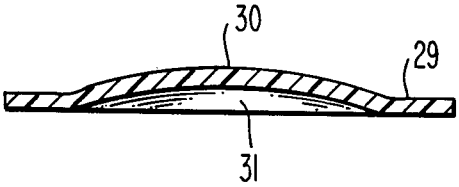
FIG. 6 is a cross-sectional view taken on line 6—6 of FIG. 5.

FIGS. 5 and 6 depict upper member 14 in the disassembled state. Upper member 14 has a shape which corresponds to the shape of the circumferential wall. For example, the circumferential wall 16 in FIGS. 1–4 is shown to be cylindrical, and therefore the upper member 14 of FIGS. 1, 5 and 6 is circular in shape. Upper member 14 has an outer peripheral portion 29 and an interior domed portion 30. As shown in FIG. 1, hollow 31, beneath domed portion 30, accommodates the bulge in the roofing membrane created by the collar 27. The cross-sectional dimension of upper member 14 is greater than the distance between the inner edges of any diametrically opposed pair of ledges 21 but less than the interior cross-sectional dimension of circumferential wall 16.

To install a roofing membrane with the securement system of the present invention, a plurality of lower members 13 are secured to a roof substrate 11, dispersed as desired over the area of the roof. A roofing membrane 12 is then rolled or placed over the substrate and the lower members. Upper members 14 are then positioned on top of roofing membrane 12 so as to lie above ledges 21 but within the interior of the circumferential wall 16 of the lower members 13. A sufficient amount of downward force is then applied to the upper members 14 to cause the non-resilient circumferential walls of the lower members 13 flex enough to allow the upper members 14 and the roofing membrane 12 to be positioned beneath the ledges 21 of the lower members 13. The downward force can be applied by hand, with a tool, or by a workman stepping down on each upper member 14, with the domed inner surfaces of the upper members making it easier for this to be accomplished.

Figure 7:
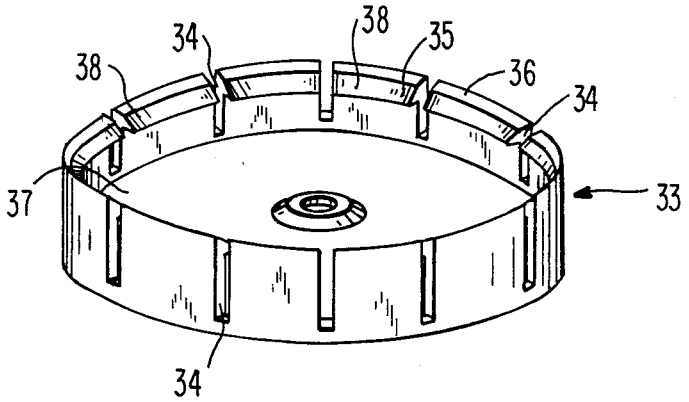
FIG. 7 depicts an alternative form of a lower member suitable for incorporation into the system of FIG. 1.

FIG. 7 depicts an alternative form of lower member 33 omitting arcuate slots 25 and instead having a plurality of slots 34 through circumferential wall 35, extending downwardly from upper edge 36 thereof either all the way to bottom surface 37 or at least a substantial part of the way, to permit wall 35 to flex.

The embodiment of FIG. 7 also omits outer flange portion 19 and has ledges 38 extending substantially all the way around circumferential wall 35, broken by slots 34.

Figure 8:
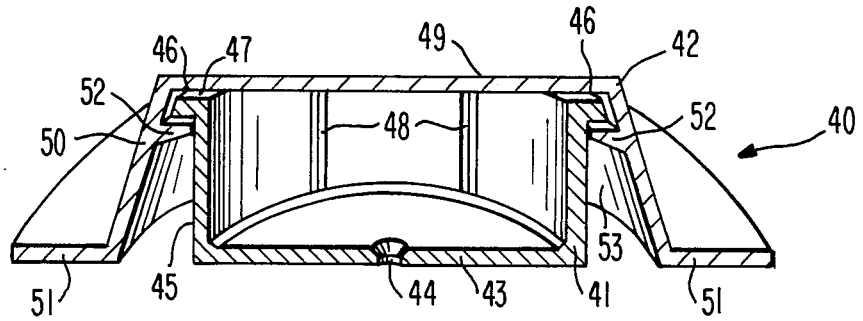
FIG. 8 depicts an alternative embodiment of a roofing membrane securement system in accordance with the present invention.

FIG. 8 depicts an alternative embodiment of roofing membrane security system 40 in accordance with the present invention, including lower member 41 and upper member 42. Lower member 41 has a planar bottom surface 43 with a throughhole 44 and a circumferential wall portion 45 having outwardly extending sloped ledges 46 adjacent the top edge 47 thereof. A plurality of slots 48 pass through wall portion 45, permitting the wall to flex. Upper member 42 has a planar top surface 49 and a sloped side surface 50 extending downwardly adjacent wall portion 45 and terminating in a planar flange portion 51. A ledge 52 extends radially inwardly from the inner surface 53 of side surface 50. Lower member 41 is fastened to a roof substrate by a bolt or other fastener passing through hole 44, and the roofing membrane is laid thereover. Upper member 42 is then placed over the membrane and the lower member 41 and pressed downward, causing wall 45 to flex so that ledge 52 snaps beneath and engages ledge 46, securing the roofing membrane to the roof substrate.

While the roofing membrane securement system has been described and exemplified in terms of a preferred embodiment, those skilled in the art will appreciate that modifications can be made without departing from the spirit and scope of this invention.

What is claimed is:

1. A roofing membrane securement system, comprising:

a lower member of relatively hard and non-resilient material and having a bottom surface portion adapted to be placed on and fastened to a substrate of a roof; a circumferential wall portion extending upwardly from said bottom surface portion; and a plurality of ledges spaced apart from one another around one circumferential surface of said wall portion, said ledges sloping downwardly from the upper edge of said wall portion; one of said circumferential wall portion and said bottom surface portion having a plurality of arcuate slots therethrough at intervals therearound and adjacent the junction of said circumfererential wall portion and said bottom surface portion to permit said circumferential wall portion to flex; and an upper member of relatively hard and non-resilient material and including means cooperating with the ledges of said circumferential wall portion to permit said upper member cooperating means to snap beneath said lower member ledges to releasably connect said upper member with said lower member;

such that with said lower member fastened to a roof substrate and a roofing membrane positioned over the roof substrate and over said lower member said upper member can be positioned on top of the roofing membrane above said ledges, and upon application of sufficient downward force to said upper member, said circumferential wall portion flexes to allow said upper member and the roofing membrane to be positioned beneath said ledges, securing the roofing membrane to the substrate.

2. A roofing membrane securement system, comprising:

a lower member of relatively hard and non-resilient material and having a bottom surface portion adapted to be placed on and fastened to a substrate of a roof; a continuous circumferential wall portion extending upwardly from said bottom surface portion; a plurality of ledges spaced apart from one another around one circumferential surface of said continuous circumferential wall portion, said ledges sloping downwardly from the upper edge of said continuous circumferential wall portion; and means formed in one of said continuous circumferential wall portion and said bottom surface portion to permit said wall continuous circumferential wall portion to flex; and an upper member of relatively hard and non-resilient material and including means cooperating with the ledges of said continuous circumferential wall portion to permit said upper member cooperating means to snap beneath said lower member ledges to releasably connect said upper member with said lower member;

such that with said lower member fastened to a roof substrate and a roofing membrane positioned over the roof substrate and over said lower member said upper member can be positioned on top of the roofing membrane above said ledges, and upon application of sufficient downward force to said upper member, said continuous circumferential wall portion flexes to allow said upper member and the roofing membrane to be positioned beneath said ledges, securing the roofing membrane to the substrate.

3. A roofing membrane securement system, comprising:

a lower member of a relatively hard and non-resilient material and having a bottom surface portion adapted to be placed on and fastened to a substrate of a roof; a circumferential wall portion extending upwardly from said bottom surface portion; a plurality of ledges spaced apart from one another around one circumferential surface of said wall portion, said ledges extending inwardly from the inner surface of said circumferential wall portion and sloping downwardly from the upper edge of said wall portion; and means formed in one of said circumferential wall portion and said bottom surface portion to permit said circumferential wall portion to flex; and an upper member of a relatively hard and non-resilient material and including an outer flange portion, with said upper member having a cross-sectional dimension less than the interior cross-sectional dimension of said circumferential wall portion but greater than the distance between the inner edges of any circumferentially opposed pair of said ledges, said outer flange portion cooperating with the ledges of said circumferential wall portion to permit said upper member flange portion to snap beneath said lower member ledges to releasably connect said upper member with said lower member;

such that with said lower member fastened to a roof substrate and a roofing membrane positioned over the roof substrate and over said lower member said upper member can be positioned on top of the roofing membrane above said ledges, and upon application of sufficient downward force to said upper member, said circumfernetial wall portion flexes to allow said upper member outer flange portion and the roofing membrane to be positioned beneath said ledges, securing the roofing membrane to the substrate.

4. A securement system as recited in claim 3 or 2 wherein said flex permitting means comprises a plurality of slots cut through said circumferential wall portion at intervals therearound.

5. A securement system as recited in claim 1 or 2 wherein said ledges extend inwardly from the inner surface of said circumferential wall portion and said upper member cooperating means comprises an outer flange portion with said upper member having a cross-sectional dimension less than the interior cross-sectional dimension of said circumferential wall portion but greater than the distance between the inner edges of any circumferentially opposed pair of said ledges.

6. A securement system as recited in claim 1 or 2 wherein said ledges extend outwardly from the outer surface of said circumferential wall portion and said upper member cooperating means comprises a sloping portion extending adjacent said circumferential wall portion and ledge means extending radially inwardly from said sloping portion and adapted to engage beneath said lower member ledges.

7. A securement system as recited in claim 1, 3 or 2 wherein said material is a hard plastic.

8. A securement system as recited in claim 1, 3 or 2 wherein said circumferential wall portion and said upper member have circular cross-sections.

9. A securement system as recited in claim 1, 3 or 2 wherein a throughhole is formed through said bottom surface portion, at substantially the center thereof, for passage therethrough of a fastening device to fasten said lower member to a roof substrate.

10. A securement system as recited in claim 9 wherein said bottom surface includes means for protecting the roofing membrane from contacting the fastening device.

11. A securement system as recited in claim 1, 3 or 2 wherein the upper surface of each of said ledges slopes downwardly and the uppermost portion of each of said ledges coincides with the upper edge of said cylindrical wall.

12. A securement system as recited in claim 11 wherein the ledges extend down along the one circumferential surface of said wall portion for about a third of the overall height of said circumferential wall portion.

13. A securement system as recited in claim 1, 3 or 2 wherein said upper and lower members are formed of the same material.

* * * * *